US008382269B2

(12) United States Patent
Zocchi et al.

(10) Patent No.: US 8,382,269 B2
(45) Date of Patent: Feb. 26, 2013

(54) SYSTEM AND METHOD THAT ENABLES A SOLID INK PRINTER TO LEARN A SOLID INK STICK TYPE

(75) Inventors: Karen V. Zocchi, Beaverton, OR (US); Brent R. Jones, Sherwood, OR (US); Timothy L. Crawford, St. Paul, OR (US); Douglas B. Henkle, Gresham, OR (US); Patricia L. Werner, Protland, OR (US)

(73) Assignee: Xerox Corporation, Norwalk, CT (US)

( * ) Notice: Subject to any disclaimer, the term of this patent is extended or adjusted under 35 U.S.C. 154(b) by 232 days.

(21) Appl. No.: 12/759,186

(22) Filed: Apr. 13, 2010

(65) Prior Publication Data

US 2011/0249066 A1 Oct. 13, 2011

(51) Int. Cl.
*B41J 2/175* (2006.01)

(52) U.S. Cl. ..... 347/88; 347/5; 347/14; 347/99

(58) Field of Classification Search ..... 347/88, 347/99, 5, 14
See application file for complete search history.

(56) References Cited

U.S. PATENT DOCUMENTS 5,124,754 A 6/1992 Higaki
5,223,860 A * 6/1993 Loofbourow et al. ..... 347/88
5,442,387 A * 8/1995 Loofbourow et al. ..... 347/88
5,752,025 A 5/1998 Shakib et al.
5,949,998 A 9/1999 Fowlow et al.
5,975,690 A * 11/1999 Grellmann et al. ..... 347/88
6,083,277 A 7/2000 Fowlow et al.
6,769,001 B2 7/2004 Halstead, Jr. et al.
7,988,274 B2 * 8/2011 Buehler et al. ..... 347/88
8,162,463 B2 * 4/2012 Jones et al. ..... 347/88
2007/0156628 A1 7/2007 Rodriguez et al.
2008/0218548 A1 * 9/2008 Fairchild et al. ..... 347/14
2009/0115824 A1 5/2009 Gold et al.
2009/0225117 A1 9/2009 Mantell
2010/0020143 A1 1/2010 Jones et al.
2010/0053282 A1 3/2010 Johnson et al.
2010/0073443 A1 3/2010 Jones

OTHER PUBLICATIONS

United Kingdom Search Report corresponding to UK Application GB1105786.6, United Kingdom Intellectual Property Office, Newport, South Wales, UK, Jul. 21, 2011 (4 pages).

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A solid ink printer is configured to learn the identity of solid ink sticks for printer operation. The solid ink printer includes a feed channel having an insertion opening configured to receive solid ink sticks, a sensor positioned near the insertion opening of the feed channel and configured to obtain solid ink stick type data from a solid ink stick inserted into the insertion opening of the feed channel, and a controller communicatively coupled to the sensor to receive the solid ink stick type data, the controller being configured to store the solid ink stick type data in a memory in response to an initialization signal and to operate the solid ink printer with reference to the solid ink stick type data stored in the memory by the controller.

12 Claims, 4 Drawing Sheets

SYSTEM AND METHOD THAT ENABLES A SOLID INK PRINTER TO LEARN A SOLID INK STICK TYPE

TECHNICAL FIELD

The solid ink stick learning system disclosed below generally relates to solid ink printers, and, more particularly, to solid ink printers having multiple feed channels for delivering different types of solid ink sticks to different melting devices.

BACKGROUND

Solid ink or phase change ink imaging devices, hereafter called solid ink printers, encompass various imaging devices, such as printers and multi-function devices. These printers offer many advantages over other types of image generating devices, such as laser and aqueous inkjet imaging devices. Solid ink or phase change ink printers conventionally receive ink in a solid form, either as pellets or as ink sticks. A color printer typically uses four colors of ink (yellow, cyan, magenta, and black).

The solid ink pellets or ink sticks, hereafter referred to as ink, sticks, or ink sticks, are delivered to a melting device, which is typically coupled to an ink loader, for conversion of the solid ink to a liquid. A typical ink loader includes multiple feed channels, one for each color of ink used in the imaging device. Each channel has an insertion opening in which ink sticks of a particular color are placed and then either gravity fed or urged by a conveyor or a spring-loaded pusher along the feed channel. Each feed channel directs the solid ink within the channel towards a melting device located at the end of the channel. Each melting device receives solid ink from the feed channel to which the melting device is connected and heats the solid ink impinging on it to convert the solid ink into liquid ink that is delivered to a print head for jetting onto a recording medium or intermediate transfer surface.

Each feed channel insertion opening may be covered by a key plate having a keyed opening. The keyed openings help ensure a printer user places ink sticks of the correct color in a feed channel. To accomplish this goal, each keyed opening has a unique shape. The ink sticks of the color corresponding to a particular feed channel have a shape corresponding to the shape of the keyed opening. The keyed openings and corresponding ink stick shapes exclude from each ink feed channel ink sticks of all colors except the ink sticks of the proper color for the feed channel.

Although keyed openings are useful for reducing the likelihood that an ink stick of the wrong color is inserted into a feed channel, ink sticks vary in other important aspects. To detect these other varying aspects and block non-compliant sticks from use in a feed channel, other ink stick identifying systems have been developed. These systems use imaging devices, contact, and/or non-contact switches and sensors to identify an ink stick inserted into a feed channel and block the feed channel in response to a non-conforming ink stick being detected. These systems, however, currently require the sensors or switches to be configured for the type of ink stick to be used in a printer at the manufacturing facility. For identification systems, data identifying the ink sticks must be stored in the printer software at the manufacturing site. In order for each printer to be configured properly at a manufacturing facility, the sensing system and/or data must be identified at the factory and installed in the printer. Thus, the intended use or customer of a machine must be known at the time that the printer is built. If completion of a printer at a manufacturing site is required before a customer can obtain a printer, a delay ensues and a potential customer may decide to purchase a more readily available device. Alternatively, establishing an inventory of multiple printers that are predefined and configured differently is impractical.

One approach for addressing this issue would be to install the identifying data in the printer at a user's site using a memory fob or data entry device, such as a keyboard or other user interface. The memory fob or keystroke sequence, however, could be surreptitiously obtained and used to program other printers for temporary use of non-conforming ink sticks. In other words, the identifying system could lose the ability to detect non-conforming ink sticks and alert the user to the potential use of such ink sticks in a printer. Non-conforming ink sticks include various ink formulations, hue and color saturations, as well as different sizes and shapes. Even if non-conforming ink sticks are used in a printer temporarily, the operation of the printheads could be affected and printed image quality degraded. The effect on ink quality may continue after the use of conforming ink sticks is commenced again. A more robust manner of enabling ink stick identification systems in printers would be beneficial.

SUMMARY

A solid ink stick printer is configured to learn solid ink stick identifying information for solid ink sticks authorized for use in the printer. The solid ink printer includes a feed channel having an insertion opening configured to receive solid ink sticks, a sensor positioned near the insertion opening of the feed channel and configured to obtain solid ink stick type data from a solid ink stick inserted into the insertion opening of the feed channel, and a controller communicatively coupled to the sensor to receive the solid ink stick type data, the controller being configured to store the solid ink stick type data in a memory in response to an initialization state being active and to operate the solid ink printer with reference to the solid ink stick type data stored in the memory by the controller.

A method of operating a solid ink printer enables the printer to learn identifying information solid ink sticks authorized for use in the printer. The method includes inserting a solid ink stick in an insertion opening of a feed channel, obtaining solid ink stick type data from a solid ink stick inserted into the insertion opening of the feed channel, storing the solid ink stick type data in a memory in response to an initialization state being active, and operating the solid ink printer with reference to the solid ink stick type data stored in the memory.

BRIEF DESCRIPTION OF THE DRAWINGS

Features for a printer that is programmed with identifying information obtained from solid ink sticks used in the printer are discussed with reference to the following drawings.

DETAILED DESCRIPTION

The term "printer" refers, for example, to reproduction devices in general, such as printers, facsimile machines, copiers, and related multi-function products. While the specification focuses on a system that images solid ink sticks in solid ink printers, the system may be used in any printer that uses marking materials to form an image. The term "controller" as used herein refers to an electronic control unit, typically including a microprocessor, a general purpose CPU, such as a CPU from the ARM family, or any data processing device adapted to send and receive data, and to control the operations of the printer. Different printer designs may include a single controller for all printer operations, or multiple controllers that each control a subset of the printer's functions. The term "memory" refers to any device capable of storing and retrieving digital information in a manner that may be used by the controller. Common examples include, but are not limited to, Dynamic Random Access Memory (DRAM), and Static Random Access Memory (SRAM). The term memory also includes non-volatile data storage devices that are capable of retaining digital information if electrical power is removed from any of the printer, controller, or memory. Common examples of non-volatile memory include magnetic hard disk drives, NOR and NAND based solid-state storage devices, battery-backed dynamic or static Random Access Memory (RAM) devices, magnetic RAM (MRAM) devices, phase-change RAM (PRAM) devices, or any device capable of retaining stored digital information in the absence of electrical power. While the memory is typically located within the housing of the printer, the memory may be physically remote from the printer, such as a data storage system that the controller accesses via a data network connection. The term "ink stick" refers to any form of solid ink such as blocks, pastilles, or other solid pieces that are delivered to a melting device for conversion to liquid ink.

Figure 1:
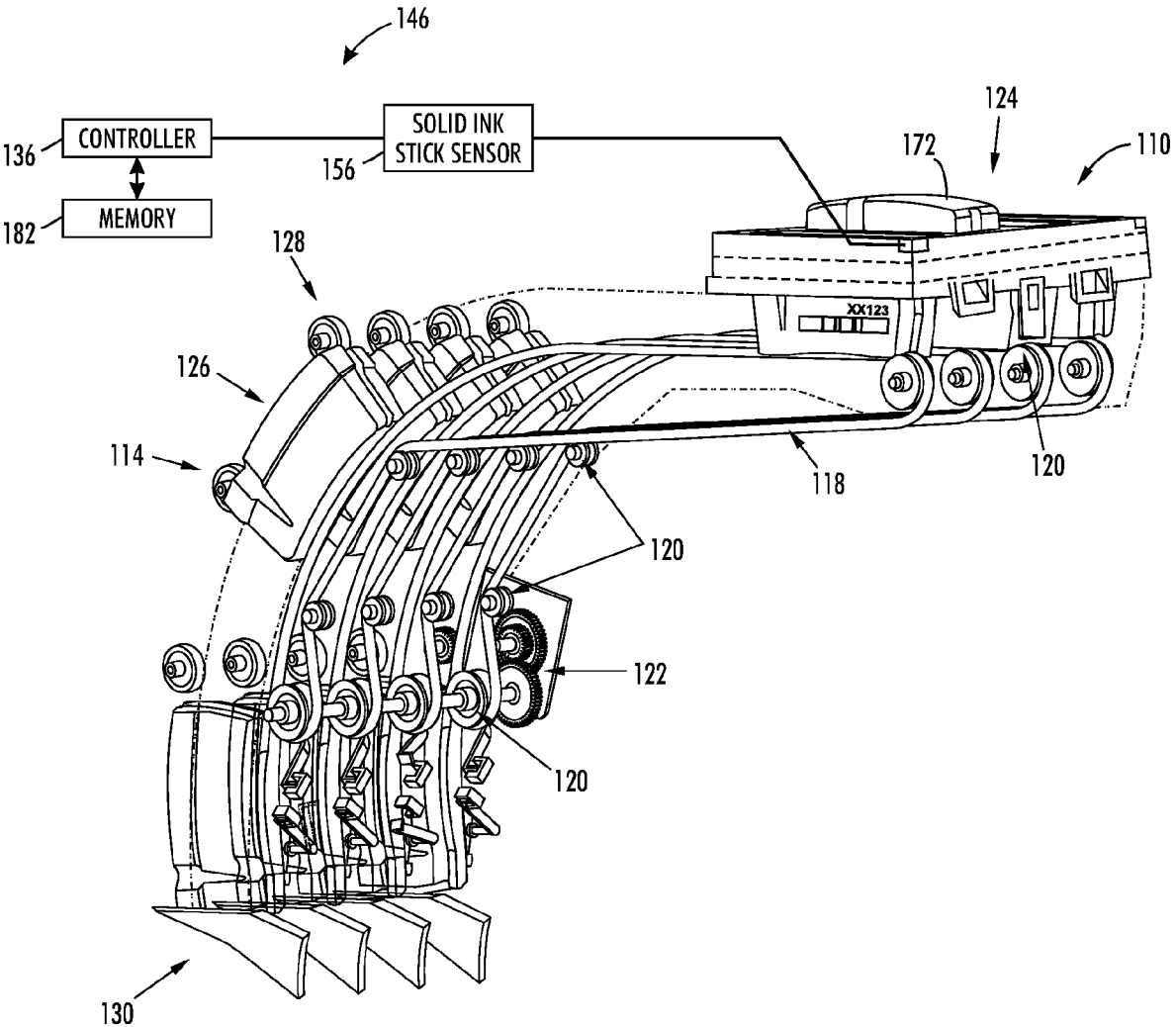
FIG. 1 is a perspective view of an ink loader in a solid ink printer.

An ink loader 110 that includes a mechanized drive and a gravity fed section is depicted in FIG. 1. As shown in the figure, a curved feed channel 114 includes an endless belt 118 mounted around pulleys 120, at least some of which are driven by a motor and gear train 122 or the like. An ink stick 126 inserted in the insertion opening of port 124 engages the belt 118 and is carried along the feed channel 114 in response to the pulleys 120 being driven. After transitioning through the curve 128, the ink stick 126 falls by force of gravity towards a melting device 130. As shown in FIG. 1, a stack of ink sticks may develop in the gravity fed portion of the feed channel 114. The weight of these sticks help urge the bottom-most stick against the melting device 130 for more efficient melting.

According to an embodiment of the present disclosure and referring to FIG. 1, a system 146 may be coupled to the ink loader 110 to identify ink supplies installed in the loader port 124 that obtains identification data of an ink supply, such as a solid ink stick 172. The system 146 includes a solid ink stick sensor 156, a controller 136, and memory 182. Controller 136 is operably and communicatively coupled to memory 182 for the storage and retrieval of data in a digital form. The digital data stored in memory 182 includes the ink stick type identification data obtained from sensor 156. The solid ink stick sensor 156 is configured to obtain solid ink stick type identification data from a solid ink stick 172 placed in port 124.

Figure 2A:
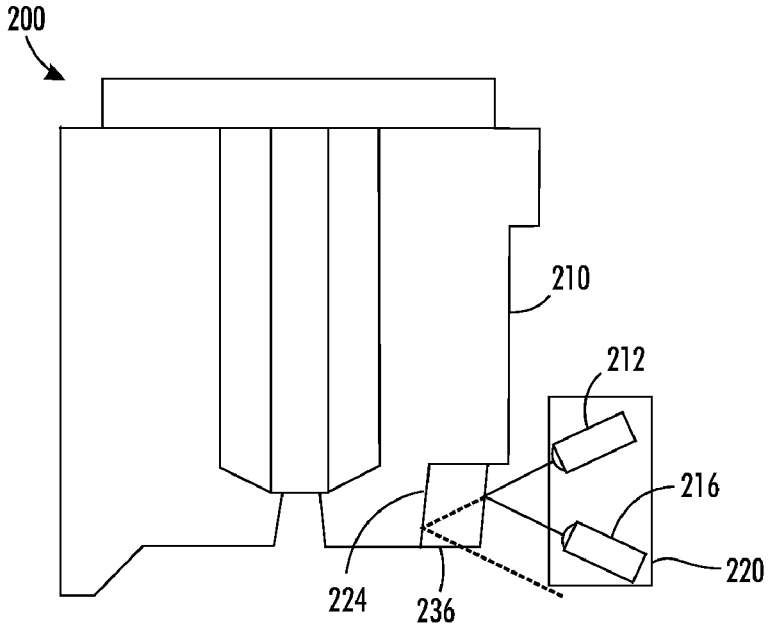
FIG. 2A is an end view of a solid ink stick with an optical sensor.
Figure 2B:
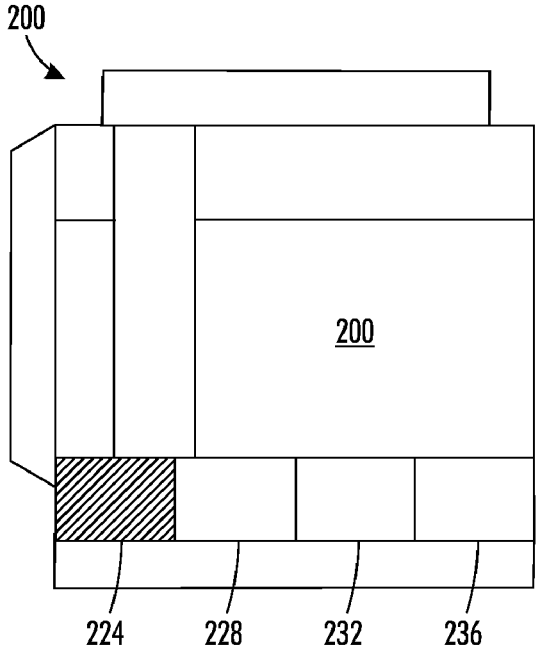
FIG. 2B is an alternative side view of the solid ink stick of FIG. 1A.

A solid ink stick 200 having identification features suited for use with an optical detector is depicted in FIG. 2A and FIG. 2B. Ink stick 200 has one or more inset areas 220, 224, and 228 that may be optionally cut into a portion of an ink stick surface, such as side 210, although ink stick surfaces may be configured with the insets. The ink stick is placed within an insertion opening for a feed channel (not shown) and evaluated for use with the printer. An optical sensor 220 is mounted proximate to the insertion opening to obtain ink stick type identification data from the ink stick placed in the insertion opening. The optical sensor 220 includes a light source 212 and an optical detector 216. The light source 212 generates light that is directed into the insertion opening at a position occupied by an ink stick placed in the insertion opening. If the portion of the ink stick in the insertion opening does not have an inset located where the light is incident on the side 210, the light is reflected by the ink stick into the detector 216, as shown by the solid line in FIG. 2A. Conversely, when an inset has been configured in the side 210 where the light is directed by the light source 212, the surface reflecting the light directs the light away from the optical detector 216, as shown by the dashed line in FIG. 2A. Thus, the optical detector 216 generates an electrical signal corresponding to the light reflected into the detector by the ink stick. The electrical signal can be converted to a digital value and input to a controller in the printer. Multiple sensors may be used in concert with multiple sensor features placed on the ink stick. In addition or as an alternative, geometry influenced variations in light intensity reflections may be detected to differentiate ink types. In this case, the controller compares the magnitude of the converted electrical signal to a threshold that enables the controller to identify whether an inset is present in the surface 210 of the ink stick.

A side view of the ink stick is shown in FIG. 2B. In this view, the surface 210 of the ink stick is depicted as having four possible inset areas 224, 228, 232, or 236. Each inset area may have an optical sensor 220 positioned proximate the insertion opening to direct light towards the ink stick. The controller operatively connected to each of the optical sensors is able to detect whether one or more of the areas 224, 228, 232, or 236 have been configured with an inset. Using a binary digit, a binary 1 may be used to represent an inset being present and a binary 0 may be used to represent no inset. Thus, with four features, up to sixteen different combinations are possible and may be used to identify sixteen different ink stick types. The binary coded word obtained from an ink stick is referred to as ink stick type identification data in this document. While a binary coded word has been described, the insets may be formed with different depths and the optical sensors may have more than one optical detector. Thus, ink stick type identification data may be represented with tertiary digits or other known digital data schemes for encoding the data. Also, ink stick configurations may have a greater or lesser number of inset areas. The ink stick type identification data may be stored by the controller in a memory operatively connected to the controller and used by the controller to operate the printer. One current implementation uses three bi-state sensor features that enable eight different combinations to be used to identify ink sticks.

The optical sensor 220 may be any suitable sensing device capable of obtaining solid ink stick type identification data from a solid ink stick and communicating the type identification data to the controller. Possible embodiments of a solid ink stick sensors include, but are not limited to, magnetic sensors that detect magnetic ink on an ink stick, or a displaceable member adapted to engage an ink stick and act on a switch or may generate an electrical signal that corresponds to a displacement distance traveled by the displaceable member.

Figure 3:
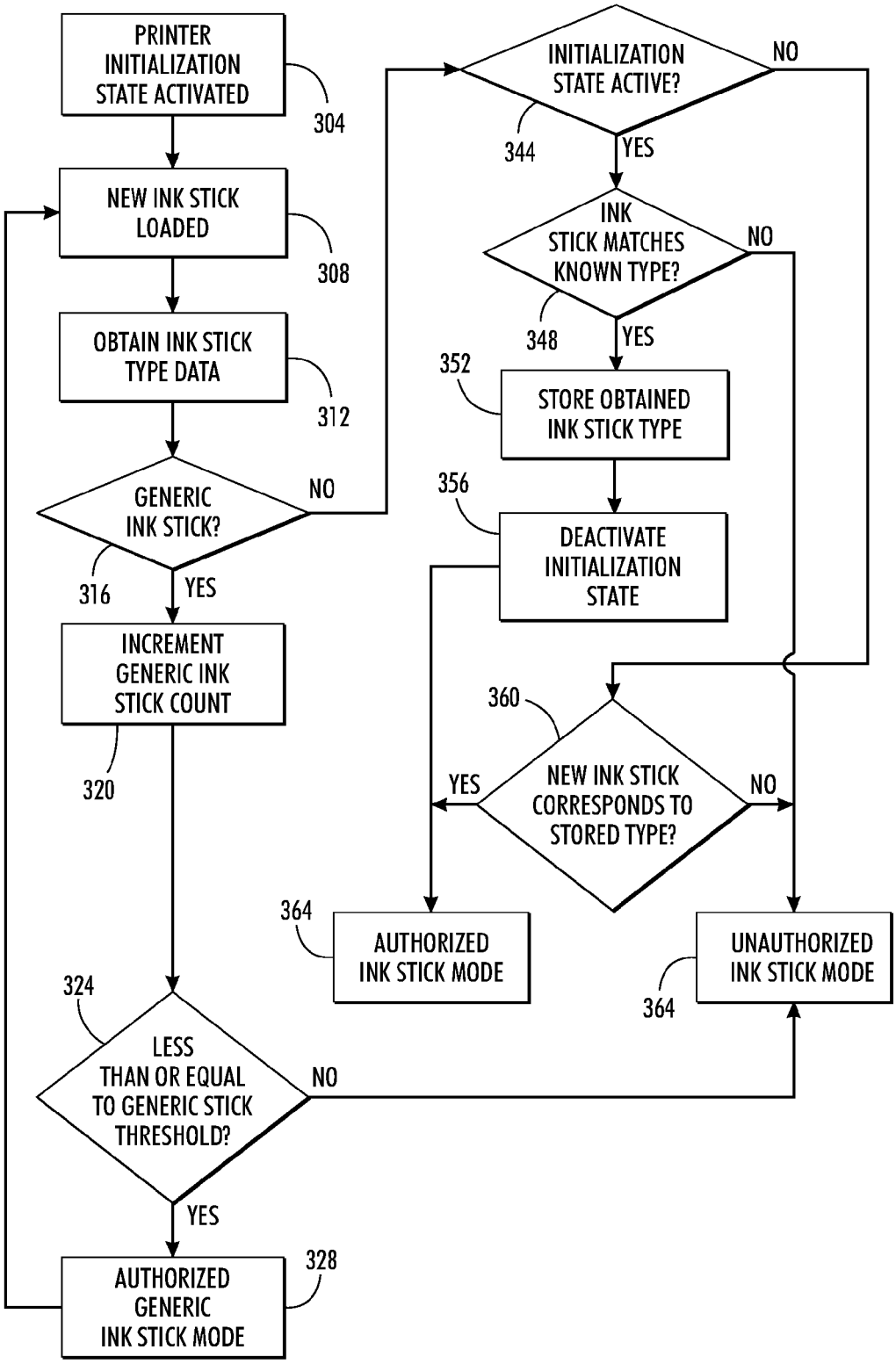
FIG. 3 is a flow diagram of a method of storing identification data from a solid ink stick.

A flow diagram of a method of ink stick identification and printer operation suitable for use with the ink stick of FIGS. 2A and 2B is shown in FIG. 3. The operating process 300 begins by activating the initialization state of the printer (block 304). Once the initialization state is activated, the process is thereafter entered at block 308 to validate an ink stick inserted in the insertion opening of a feed channel. The initialization may be conducted during manufacture of a printer, but perhaps more typically, initialization is performed during or soon after initial installation of a new printer at a customer site. During initialization, which is allowed only when a printer is in an initialization mode or state, a first ink stick is loaded into the printer (block 308). Ink stick type identification data is then obtained from the ink stick with a sensor as described above (block 312). The identification data obtained from the ink stick is compared to a generic ink stick type identification code (block 316). If the ink stick is a generic ink stick, such as an ink stick supplied with a new printer for convenience, a generic ink stick count is incremented (block 320). If the generic ink stick count is less than a predetermined threshold (block 324), the printer accepts the generic ink stick and operates the printer using the generic ink stick (block 328) until a new ink stick is loaded (block 308). If the generic ink stick count exceeds the predetermined count, which is indicative of improperly obtained or non-conforming ink sticks, the printer operates the printer in a mode that corresponds to an unauthorized ink stick being inserted in the printer (block 332). For example, the printer may have one or more gates or transporters that need to operate to enable an ink stick in the insertion opening to enter the feed channel and be fed to the melting device. These gates and/or transporters may not be operated to prevent the unauthorized ink stick from being used in the printer. Alternatively or additionally, a display operatively connected to the controller may be operated to display a message to the user indicating a limit on the number of generic ink sticks has been reached. The message may also indicate the type or types of ink stick that may be inserted in the printer for authorized operation of the printer. Operation of the printer may also be altered or prevented. The number of generic ink sticks supplied with the printer for user convenience may be equal to or less than the programmed generic ink stick allowed count.

Again with reference to FIG. 3, if a non-generic ink stick is detected (block 316), the controller determines whether the initialization state is active (block 344). To be stored as the type data for the ink sticks that can be used in the printer, the solid ink stick type identification data must correspond to one of a plurality of ink stick type identification words stored in the memory operatively connected to the controller (block 348). These ink stick identification words comprise a group of ink stick types that may be used in the printer. If the new ink stick type identification data corresponds with one of the ink stick identification words stored in the memory operatively connected to the controller, the solid ink stick type identification data obtained from the new ink stick is stored in the memory operatively connected to the controller as the authorized ink stick type for printer operation (block 352) and the initialization state is deactivated or reset (block 356) and the controller operates the printer with reference to an authorized ink stick being detected (block 364). If the new ink stick type identification data does not correspond with one of the ink stick identification words stored in the memory operatively connected to the controller (block 348), then the printer is operated in the unauthorized ink stick mode (block 332).

If the initialization state is not active (block 344), ink stick type identification data has been stored in the memory during a previous initialization state. Therefore, the controller compares the ink stick type identification data obtained from the ink stick with the ink stick type identification data stored in the memory operatively connected to the controller (block 360). If the ink stick type identification data on the ink stick in the insertion opening corresponds to the ink stick type identification data stored in the memory, then the controller operates the printer in an authorized ink stick mode (block 364). Otherwise, the controller operates the printer in the unauthorized ink stick mode (block 332).

The process of FIG. 3, as long as the initialization state is active, enables a non-generic ink stick to be inserted at any time, including initial use by the customer, to set the ink stick type for the printer. Even after the ink stick type is set, generic sticks may be used up to any count limit. Once the ink stick type is set, the controller responds to the insertion of an ink stick having different type data other than a generic ink stick by precluding use of the non-generic ink stick and responding in a manner consistent with the recognition of an ink stick type that does not conform to the ink stick type data stored during the initialization state, as previously described. Ink sticks inserted in the insertion opening after the authorized ink stick type is stored in the memory operatively connected to the controller are one of three types: generic ink sticks, authorized ink sticks, or unauthorized ink sticks. Generic ink sticks may no longer be accepted if the generic ink stick allowed count is exceeded (blocks 324). For other ink stick types, the controller determines whether the ink stick type identification data on the stick corresponds with the ink stick type identification stored in the memory during the initialization state (block 360) and operates the printer in the authorized mode if the type data does correspond (block 364) and operates the printer in the unauthorized mode if the type data does not correspond.

The process shown in FIG. 3 is exemplary only and may be performed in other ways. This process enables a printer to be delivered to a customer without specifying at the factory the type of ink sticks to be used with the printer. Instead, the printer is able to accept a predetermined number of generic ink sticks, which may typically be carried by service personnel for system setup, service, or repair. The programming is performed by inserting one of a group of ink stick types into the printer and then the ink stick type corresponding to the inserted ink stick is stored and used to evaluate ink sticks inserted into the printer thereafter. Printers delivered from the manufacturing facility would typically be able to accept only a limited number of generic ink stick types for operational purposes and once the first acceptable ink stick type is accepted, the printer is thereafter limited to use with that non-generic ink stick type. In this manner, only a member of a small spectrum of solid ink sticks is capable of being selected as the only type of solid ink stick that can be used in the printer.

Figure 4:
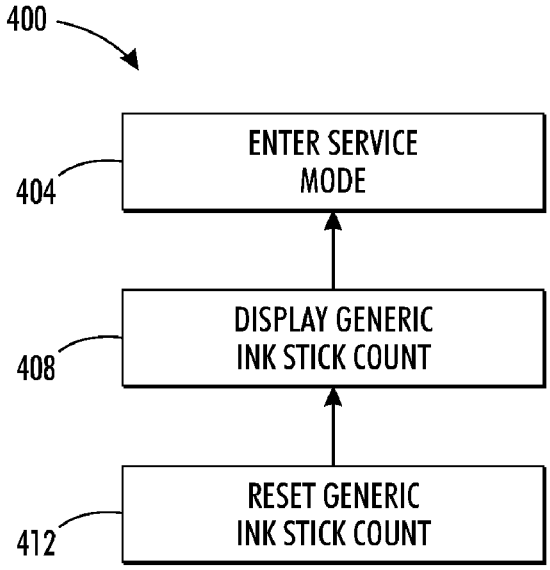
FIG. 4 is a flow diagram of a process for accepting generic ink sticks after programming of a printer with ink stick type data.

To provide additional flexibility for servicing of the printer, the printer may be placed in a service or diagnostic mode by service personnel in a known manner. The service mode may be used to enable the printer to accept additional generic ink sticks and/or be reprogrammed. An example of a service mode process useful for these purposes is shown in FIG. 4. In that process 400, the printer enters the service mode (block 404), the printer may display the generic ink stick count (block 408). Using actuators or screen touch areas implemented in a user interface, the service person can reset the generic ink stick count (block 412). Resetting this count to zero or a value less than the allowed maximum count enables the printer to accept generic ink sticks for printer operation up to the allowed count. Typically, the service person would change the generic ink stick count to a value corresponding to a number of generic ink sticks the service person anticipates being needed for the service call. Once a number of generic ink sticks are used that return the generic ink stick count to the predetermined number limit, the printer would again reject subsequent generic ink sticks An alternative scenario may be used to reset the type of ink sticks used with the printer. For example, a customer may purchase a printer and program the printer with the ink stick type associated with a buy-as-needed program in the customer's geographical region. After some time, the customer may observe that the number of copies being made with the printer qualify the customer for a "supplies provided" program in which the customer uses an ink stick type associated with a per-copy charge. After the appropriate change in the program for the customer, a service person could put the printer in the ink type initialization state to enable the insertion of the next non-generic ink stick to set the ink stick type for the printer. That next non-generic ink stick should be the type of ink stick provided through the "supplies provided" program for the customer's geographical region. The printer thereafter accepts the appropriate "supplies provided" ink sticks and no longer accepts the ink sticks having ink stick type identification data corresponding to the buy-as-needed program.

In the unauthorized ink stick mode of operation, the printer may take one or more actions consistent with the detection of an ink stick type that does not correspond to the ink stick type stored in the memory of the printer. These actions include sequestration of the unauthorized ink stick, cessation of printing operations, and/or recordation of the use of an unauthorized ink stick. The printer may also prevent the unauthorized ink stick from being used in printing operations, but allow the unauthorized ink stick to be removed, and a new ink stick corresponding to the stored ink stick type to be loaded. For example, the controller may leave a stop member in an extended position to prevent the inserted ink stick from traveling down a feed channel to a melting device. The stop member may remain in the extended position until the ink stick is removed and a new ink stick is inserted for identification. Other operations consistent with an unauthorized ink stick being inserted include illuminating an ink stick unacceptable indicator, displaying a message regarding the non-conforming aspect of the inserted ink stick, blocking an access door to the ink loader, powering down the printer, or the like. Printer operations consistent with the insertion of an authorized ink stick include typical printer operations to produce printed images and may also provide for illumination of an ink stick acceptable indicator, display of a message that the loaded ink stick is acceptable, or the like. Regardless of other printer responses to the insertion of unauthorized ink sticks, some functions may be allowed to continue unaffected, such as scanning.

Figure 5:
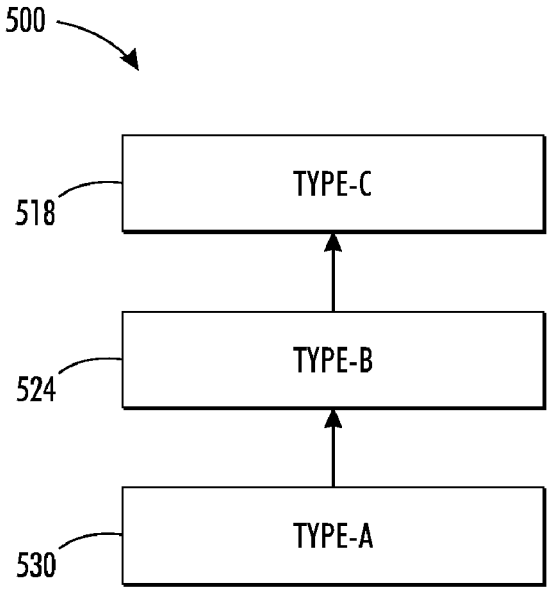
FIG. 5 is a block diagram of an exemplary ordered list of ink stick identifiers that may be used with the method of FIG. 2.

Usage of ink sticks other than generic or the set ink type may be enabled when alternate use does not have a detrimental effect, such as allowing sticks sold at a greater price than the ink stick type stored in the printer. In this example, pricing influences desirability such that gray market, arbitrage, and inappropriate geographic redistribution may be self regulating. FIG. 5 depicts an example of an ordered list of ink stick identifiers that enables ink sticks other than the one used to program the printer to be used in the operation of the printer. In FIG. 5, ordered list 500 includes identification information for ink sticks including Type-C 518, Type-B 524, and Type-A 530 sticks. The identifiers are further arranged in a one-way order starting with the Type-A identifier 530 going to Type-C identifier 518. When identification information for a detected ink stick is stored in memory, it may correspond to one of the types in the ordered list 500. If ink stick identification information for a "Type-B" ink stick is stored in a printer's memory, the identification information corresponds to the identifier 524 in FIG. 5. After this identification information is stored in the memory, newly loaded ink sticks will be acceptable if they correspond to one of the ink stick types stored in FIG. 5 that may be reached from the corresponding entry in the ordered list. As an example, if identification information for a Type-B ink stick is stored in memory, then either a newly loaded Type-B ink stick 524 or a Type-C ink stick 518 is acceptable. However, the Type-A ink stick 518 cannot be reached in ordered list 500 when starting from the Type-B list entry 524. This means a Type-A ink stick would not be accepted for use with the printer. A printer may optionally compare identification information of newly loaded ink sticks one or more ordered lists such as ordered list 500 where the order may be determined using various criteria including ink stick size, ink quality, or ink cost.

In the embodiments discussed above, only one insertion opening and feed channel have been discussed. Solid ink printers typically have multiple feed channels and sensors to support printing with a plurality of colored inks. Each feed channel would have its own insertion opening and be independently programmable. These features enable, for example, generic ink insertion counts to be tracked for each color. Alternatively, once one of the insertion openings receives an ink stick having ink stick type data corresponding to one of the members of the group stored in the printer and the ink stick type data is stored in the memory, that ink stick type data controls the evaluation of all ink sticks loaded into any of the insertion openings. Alternative methods for using a controller to compare solid ink stick type data obtained from a solid ink stick to type data stored in memory are also envisioned. For example, an ordered list of solid ink stick type data could be stored in the memory during manufacture of a solid ink printer. The ordered lists ranks different solid ink stick types according to one or more factors, including the ink stick size or price. Separate rankings could exist for different ink colors. For example an ordered list of acceptable ink types may be limited to black ink sticks.

It will be appreciated that variants of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

We claim:

1. A solid ink printer comprising:

a feed channel having an insertion opening configured to receive solid ink sticks;

a sensor positioned near the insertion opening of the feed channel and configured to obtain solid ink stick type data from a solid ink stick inserted into the insertion opening of the feed channel; and a controller operatively connected to the sensor to receive the solid ink stick type data, the controller being configured to store the solid ink stick type data in a memory during an active initialization state and to operate the solid ink printer with reference to the solid ink stick type data stored in the memory by moving a gate blocking the feed channel only in response to a subsequent solid ink stick inserted in the insertion opening providing solid ink stick type data corresponding to the solid ink stick type data stored in the memory by the controller.

2. The solid ink printer of claim 1, the sensor further comprising:

at least one light source that directs light into a portion of an area of the insertion opening in the feed channel where a solid ink stick is inserted; and a detector positioned proximate the at least one light source to detect reflection of light by a solid ink stick inserted into the insertion opening of the feed channel.

3. The solid ink printer of claim 1, the controller being further configured to detect a generic solid ink stick from the solid ink stick type data received from the sensor, to generate a count of generic solid ink sticks, and to alter printer operation in response to the count of generic solid ink sticks exceeding a predetermined threshold.

4. The solid ink printer of claim 1, the controller being further configured to store in the memory the solid ink stick type data for a next solid ink stick inserted in the insertion opening of the feed channel in response to a reset signal being received by the controller.

5. A solid ink printer comprising:

a feed channel having an insertion opening configured to receive solid ink sticks;

a sensor positioned near the insertion opening of the feed channel and configured to obtain solid ink stick type data from a solid ink stick inserted into the insertion opening of the feed channel; and a controller operatively connected to the sensor to receive the solid ink stick type data, the controller being configured to store the solid ink stick type data in a memory during an active initialization state and to operate the solid ink printer with reference to the solid ink stick type data stored in the memory by enabling use in the printer of an ink stick having ink stick type data that does not correspond with the stored ink stick type data in response to the ink stick type identification data on the ink stick corresponding to ink stick type data stored in the memory that is at least equal in rank to the solid ink stick type data stored in the memory during the active initialization state by the controller.

6. The solid ink printer of claim 5, the sensor further comprising:

at least one light source that directs light into a portion of an area of the insertion opening in the feed channel where a solid ink stick is inserted; and a detector positioned proximate the at least one light source to detect reflection of light by a solid ink stick inserted into the insertion opening of the feed channel.

7. The solid ink printer of claim 5, the controller being further configured to detect a generic solid ink stick from the solid ink stick type data received from the sensor, to generate a count of generic solid ink sticks, and to alter printer operation in response to the count of generic solid ink sticks exceeding a predetermined threshold.

8. The solid ink printer of claim 5, the controller being further configured to store in the memory the solid ink stick type data for a next solid ink stick inserted in the insertion opening of the feed channel in response to a reset signal being received by the controller.

9. A solid ink printer comprising:

a feed channel having an insertion opening configured to receive solid ink sticks;

a sensor positioned near the insertion opening of the feed channel and configured to obtain solid ink stick type data from a solid ink stick inserted into the insertion opening of the feed channel; and a controller operatively connected to the sensor to receive the solid ink stick type data, the controller being configured to store the solid ink stick type data in a memory during an active initialization state and to operate the solid ink printer with reference to the solid ink stick type data stored in the memory by moving a gate blocking the feed channel in response to a solid ink stick having solid ink stick type data that corresponds to generic ink stick type data.

10. The solid ink printer of claim 9, the sensor further comprising:

at least one light source that directs light into a portion of an area of the insertion opening in the feed channel where a solid ink stick is inserted; and a detector positioned proximate the at least one light source to detect reflection of light by a solid ink stick inserted into the insertion opening of the feed channel.

11. The solid ink printer of claim 9, the controller being further configured to detect a generic solid ink stick from the solid ink stick type data received from the sensor, to generate a count of generic solid ink sticks, and to alter printer operation in response to the count of generic solid ink sticks exceeding a predetermined threshold.

12. The solid ink printer of claim 9, the controller being further configured to store in the memory the solid ink stick type data for a next solid ink stick inserted in the insertion opening of the feed channel in response to a reset signal being received by the controller.

* * * * *